US006810703B1

(12) United States Patent
Huang et al.

(10) Patent No.: US 6,810,703 B1
(45) Date of Patent: Nov. 2, 2004

(54) CASING STRUCTURE FOR A COTTER-PIN TYPE LOCK CORE

(75) Inventors: Chih-Cheng Huang, Kaohsiung Hsien (TW); Chih-Ming Su, Kaohsiung Hsien (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 96 days.

(21) Appl. No.: 10/465,591

(22) Filed: Jun. 20, 2003

(51) Int. Cl.[7] ..... E05B 9/04

(52) U.S. Cl. ..... 70/373; 70/DIG. 15; 70/367; 70/372

(58) Field of Search ..... 70/373, 378, DIG. 15, 70/367, 359, 371, 372, 448

(56) References Cited

U.S. PATENT DOCUMENTS 1,736,685 A * 11/1929 Wilder ..... 70/375
2,111,098 A * 3/1938 Segal ..... 70/493
2,977,786 A * 4/1961 Kendrick et al. ..... 70/493
3,176,488 A * 4/1965 Jacobi ..... 70/373
3,673,831 A * 7/1972 Nelson ..... 70/373
3,774,423 A * 11/1973 Orr ..... 70/375
4,123,926 A * 11/1978 Elder ..... 70/369
4,472,953 A * 9/1984 Gater ..... 70/373
6,170,307 B1 * 1/2001 Feder ..... 70/419

* cited by examiner

*Primary Examiner*—John B. Walsh
(74) *Attorney, Agent, or Firm*—Bacon & Thomas, PLLC

(57) ABSTRACT

A casing structure for a cotter-pin type lock core is consisted of a semi-cylindrical casing which defines a longitudinal axis. The semi-cylindrical casing includes a first sidewall, a first side edge, at least one first engaging portion, a second sidewall, a second side edge and at least one second engaging portion. The first engaging portion and the second engaging portion are extended from the first side edge and the second side edge respectively, and adapted to engage with the lock core. The first side edge and the second side edge are opposite and define a maximum diameter. And the first engaging portion and the second engaging portion define a width that is slightly smaller than the maximum diameter defined by the first side edge and the second side edge.

7 Claims, 5 Drawing Sheets

CASING STRUCTURE FOR A COTTER-PIN TYPE LOCK CORE

BACKGROUND OF THE INVENTION

1. Field of the Invention

The present invention is related to a casing structure for a cotter-pin type lock core. More particularly, the present invention is related to a removable casing structure for preventing release of cotter pins from a lock core by accident.

2. Description of the Related Art

Referring to FIG. 1, a conventional cotter-pin type lock core includes a lock stator 90 and a lock rotor 92. The lock stator 90 is regarded as an outer housing and provided with a cylindrical hole 91 adapted to accommodate the lock rotor 92 for allowing axial rotation. The lock stator 90 and the lock rotor 92 are formed with a plurality of pinholes 93 for receiving elastic members 94, upper cotter pins 95 and lower cotter pins 96. The lock stator 90 is further provided with a plurality of through holes 99 which are aligned with the pinholes 93. A key 97 is able to insert into a keyway 98 formed on the lock rotor 92 for unlocking. To remove or change the cotter pins 95 and 96, the lock rotor 92 is turned to align the pinholes 93 with the through holes 99 of the lock stator 90. Consequently, an unwanted set of lower cotter pins 96 can be replaced.

When the lower cotter pins 96 are replaced, the lock rotor 92 must be turned to avoid releasing the lower cotter pins 96 through the through holes 99. However, an inappropriate rotation of the lock rotor 92 may align the pinholes 93 with the through holes 99 that may cause an accident release of the lower cotter pins 96 through the through holes 99.

Taiwanese Patent Publication No. 332,572 discloses a removable structure for a cotter-pin type lock core and a key thereof. The cotter-pin type lock core is provided with a plurality of sealing members which are adapted to seal corresponding pinholes by screw-connection.

Furthermore, Taiwanese Patent Publication No. 489,879 discloses a cotter-pin type lock core and a cotter-pin cover combined therewith. The cotter-pin cover is adapted to cover pinholes by engaging the cotter-pin cover with the lock core.

Still, there is a need for a guard device for a cotter-pin type lock core which is convenient for changing cotter pins.

The present invention intends to provide a casing structure for a cotter-pin type lock core, and the casing structure is removable and convenient for assembling with the lock core in such a way to mitigate and overcome the above problem.

SUMMARY OF THE INVENTION

The primary objective of this invention is to provide a casing structure for a cotter-pin type lock core which is convenient for assembling with the lock core that prevents cotter pins from release.

The secondary objective of this invention is to provide a casing structure for a cotter-pin type lock core which is convenient for removing from the lock core and resealing it after changing cotter pins.

The casing structure for a cotter-pin type lock core in accordance with the present invention consisted of a semi-cylindrical casing which defines a longitudinal axis. The semi-cylindrical casing includes a first sidewall, a first side edge, at least one first engaging portion, a second sidewall, a second side edge and at least one second engaging portion. The first engaging portion and the second engaging portion are extended from the first side edge and the second side edge respectively, and adapted to engage with the lock core. The first side edge and the second side edge are opposite and define a maximum diameter. And the first engaging portion and the second engaging portion define a width that is slightly smaller than the maximum diameter defined by the first side edge and the second side edge.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

DETAILED DESCRIPTION OF THE INVENTION

Figure 2:
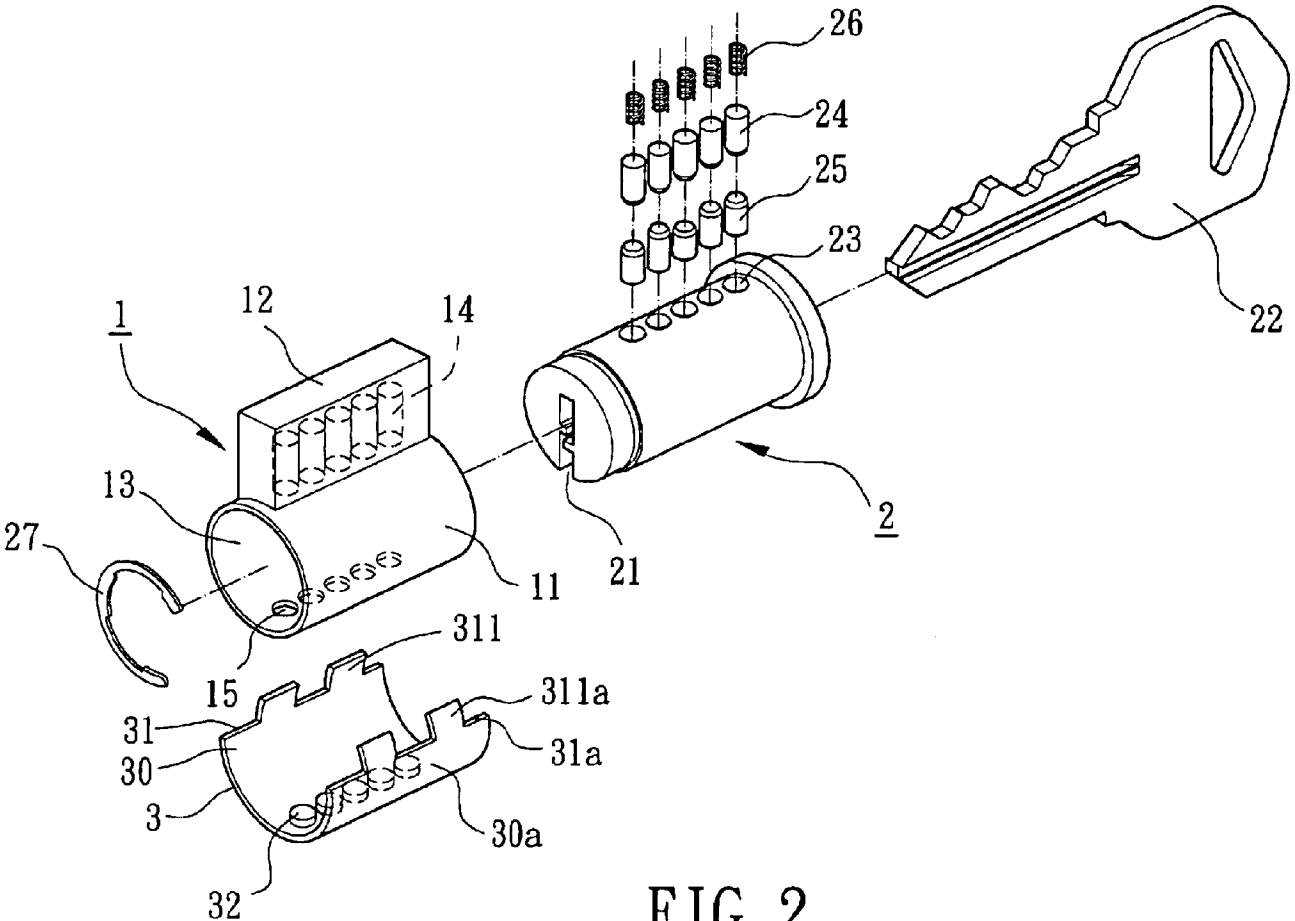
FIG. 2 is an exploded perspective view of a casing structure for a cotter-pin type lock core in accordance with the present invention.

Referring initially to FIG. 2, the present invention generally includes a lock core member and a casing member designated numeral.

Referring again to FIG. 2, a casing structure for a cotter-pin type lock core in accordance with the preferred embodiment of the present invention consisted of a semi-cylindrical casing 3 which defines a longitudinal axis. The semi-cylindrical casing 3 is axially combined with the lock core in a longitudinal direction.

Referring again to FIG. 2, the lock core is consisted of a lock stator 1 and a lock rotor 2 rotatably received therein. The lock stator 1 includes a main body 11 and a pinhole seat 12 attached thereto. The main body is formed as a cylinder, and provided with a passage 13 and a plurality of through holes 15 connected thereto. The passage 13 is adapted to accommodate the lock rotor 2 for allowing axial rotation. The pinhole seat 12 is provided with a plurality of upper pinholes 14 aligned with the through holes 15.

Figure 3:
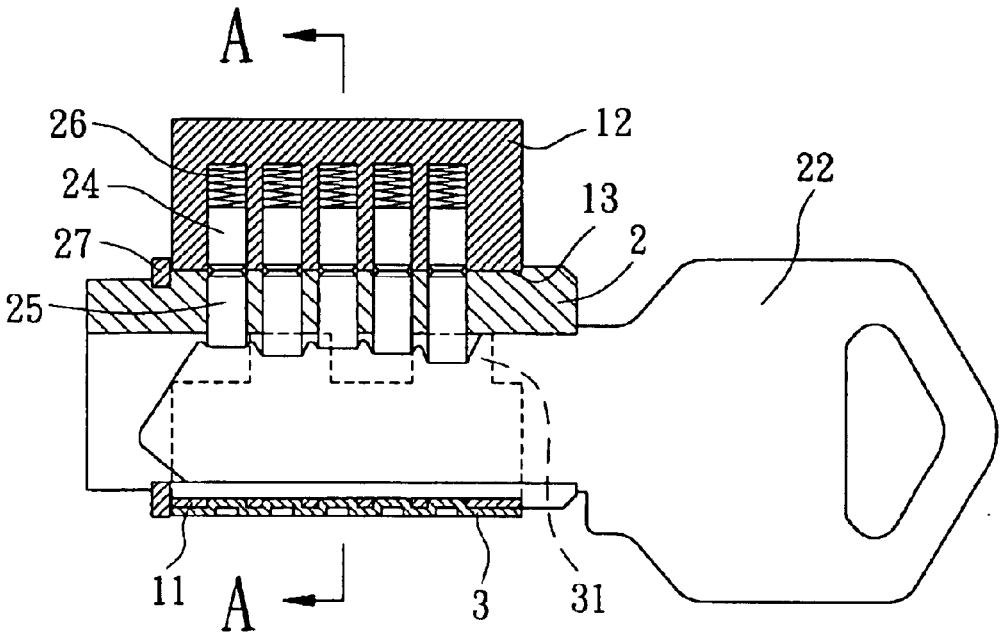
FIG. 3 is a cross-sectional view of the casing structure for the cotter-pin type lock core in accordance with the present invention inserted by a key.

Referring to FIGS. 2 and 3, the lock rotor 2 includes a keyway 21 into which to insert a key 22. The key 22 is in contact with the lower cotter pins 25 and thus able to rotate the lock rotor 2 in the lock stator 1. The lock rotor 2 is provided with a plurality of lower pinholes 23 corresponding to the upper pinholes 14 of the lock stator 1.

Figure 4:
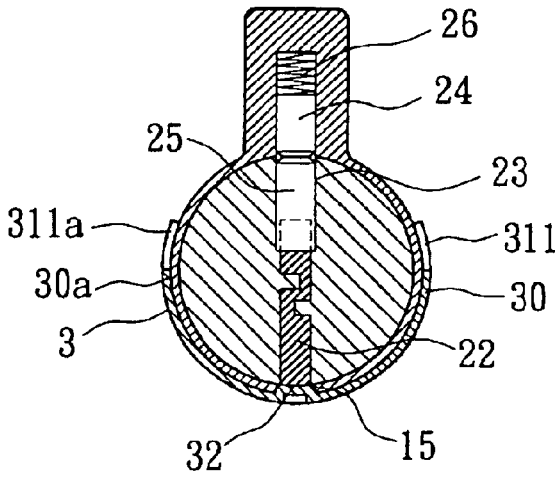
FIG. 4 is a cross-sectional view, taken along line A—A in FIG. 3, of the casing structure for the cotter-pin type lock core in accordance with the present invention.

Referring to FIGS. 2 through 4, upper cotter pins 24, lower cotter pins 25 and elastic members 26 are nested and sealed in the associated upper pinholes 14 of the lock stator 1 and the associated lower pinholes 23 of the lock rotor 2 respectively. In operation, the key 22 is able to actuate the upper cotter pins 24, the lower cotter pins 25 and the elastic members 26 through the keyway 21 of the lock rotor 2.

Referring again to FIG. 2, the semi-cylindrical casing 3 is made of elastic material selected from a group consisted of plastic and metal etc. The semi-cylindrical casing 3 has an arc cross-section which is identical with that of an outer surface of the lock stator 1. The semi-cylindrical casing 3 includes a first sidewall 30, a first side edge 31, a pair of first engaging portions 311, a second sidewall 30*a*, a second side edge 31*a* and a pair of second engaging portions 311*a*. The first engaging portions 311 and the second engaging portions 311*a* are extended from the first side edge 31 and the second side edge 31*a* respectively, and proximal the two ends of the semi-cylindrical casing 3. Preferably, the first engaging portions 311 and the second engaging portions 311*a* are elastic members, and thus able to elastically engage with the lock core.

Referring again to FIGS. 2 and 4, the first side edge 31 and the second side edge 31*a* are opposite and define a maximum diameter. And the first engaging portion 311 and the second engaging portion 311*a* define a width that is slightly smaller than the maximum diameter defined by the first side edge 31 and the second side edge 31*a*. Moreover, the semi-cylindrical casing 3 is further provided with protrusions 32 which is adapted to engage with the through holes 15 of the lock stator 1, thereby increasing in assembled relationship between the lock stator 1 and the semi-cylindrical casing 3. Preferably, the protrusions 32 have a common thickness identical with that of the through holes 15.

Referring again to FIGS. 3 and 4, in assembling operation, the lock rotor 2 is inserted into the passage 13 of the lock stator 1. Subsequently, a C clip 27 or a retaining member is engaged with a distal end of the lock rotor 2 so that the lock rotor 2 is retained in the lock stator 1. Meanwhile, the correct key 22 is able to actuate an axial rotation of the lock rotor 2 with respect to the lock stator 1. The first engaging portion 311 and the second engaging portion 311*a* of the semi-cylindrical casing 3 are elastically engaged with the outer surface of the lock stator 1, thereby attaching the semi-cylindrical casing 3 to the lock stator 1. Consequently, each of the through holes 15 of the lock stator 1 is inserted and sealed by the corresponding protrusion 32 of the semi-cylindrical casing 3.

Figure 5:
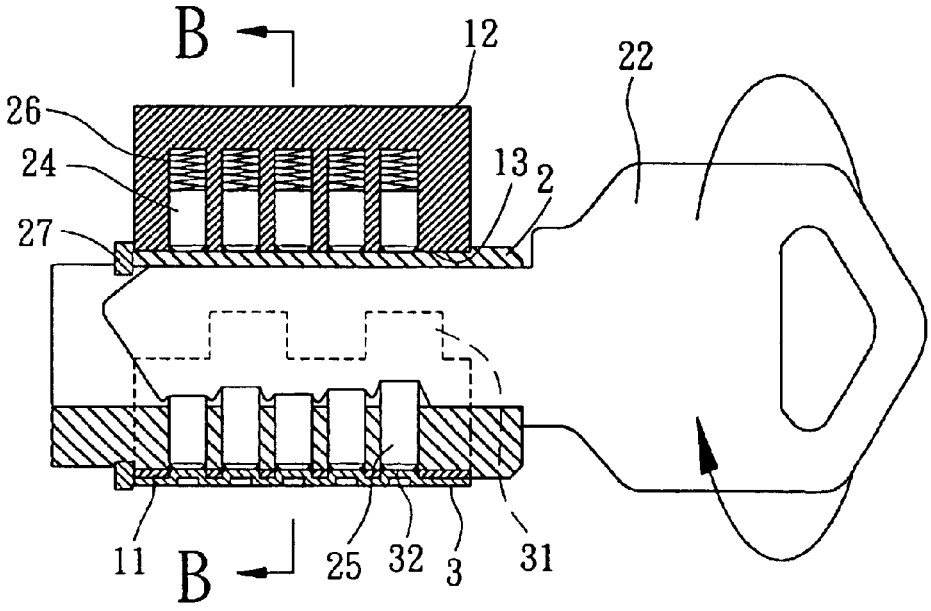
FIG. 5 is a cross-sectional view of a key rotating a lock rotor 180 degrees in the casing structure for the cotter-pin type lock core in accordance with the present invention.
Figure 6:
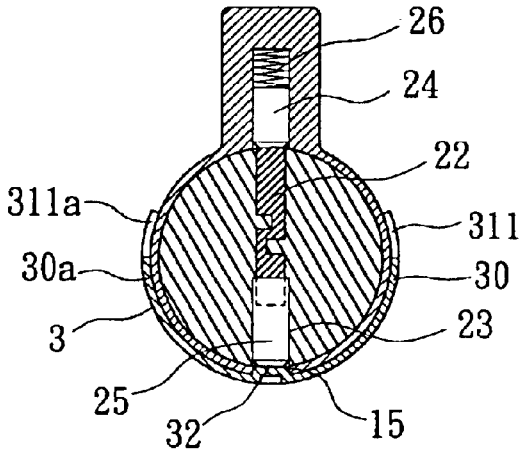
FIG. 6 is a cross-sectional view, taken along line B—B in FIG. 5, of the casing structure for the cotter-pin type lock core in accordance with the present invention.

Referring to FIGS. 5 and 6, in turning operation, the key 22 is used to turn the lock core 2 an angle of 180 degrees with respect to the lock stator 1. Thereby, the pinholes 23 of the lock rotor 2 are aligned with the through holes 15 of the lock stator 1. The lower cotter pins 25 remained in the pinholes 23 of the lock rotor 2 are unable to release through the through holes 15 of the lock stator 1 by accident since they are sealed by the protrusions 32 of the semi-cylindrical casing 3.

Figure 7:
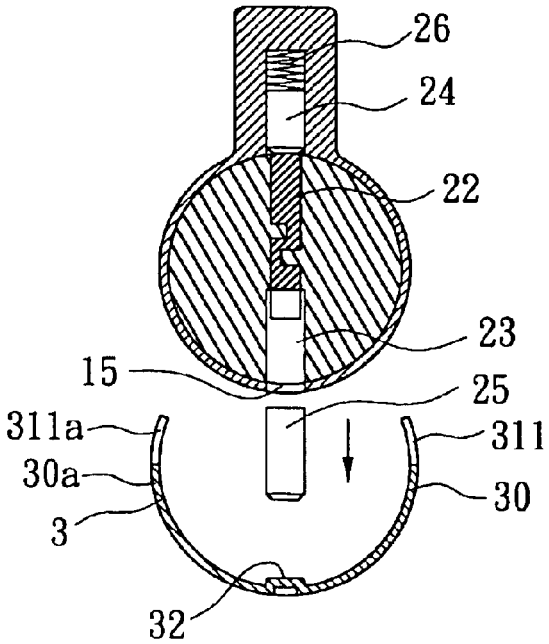
FIG. 7 is an exploded view of the casing structure and the cotter-pin type lock core in accordance with the present invention.

Referring to FIG. 7, in changing cotter-pin operation, firstly, the semi-cylindrical casing 3 is removed from the lock stator 1. Consequently, the lower cotter pins 25 are able to release from the pinholes 23 of the lock rotor 2. In this circumstance, it is allowed to replace the key 22 and the lower cotter pins 25 by a new key and a new set of cotter pins.

Figure 1:
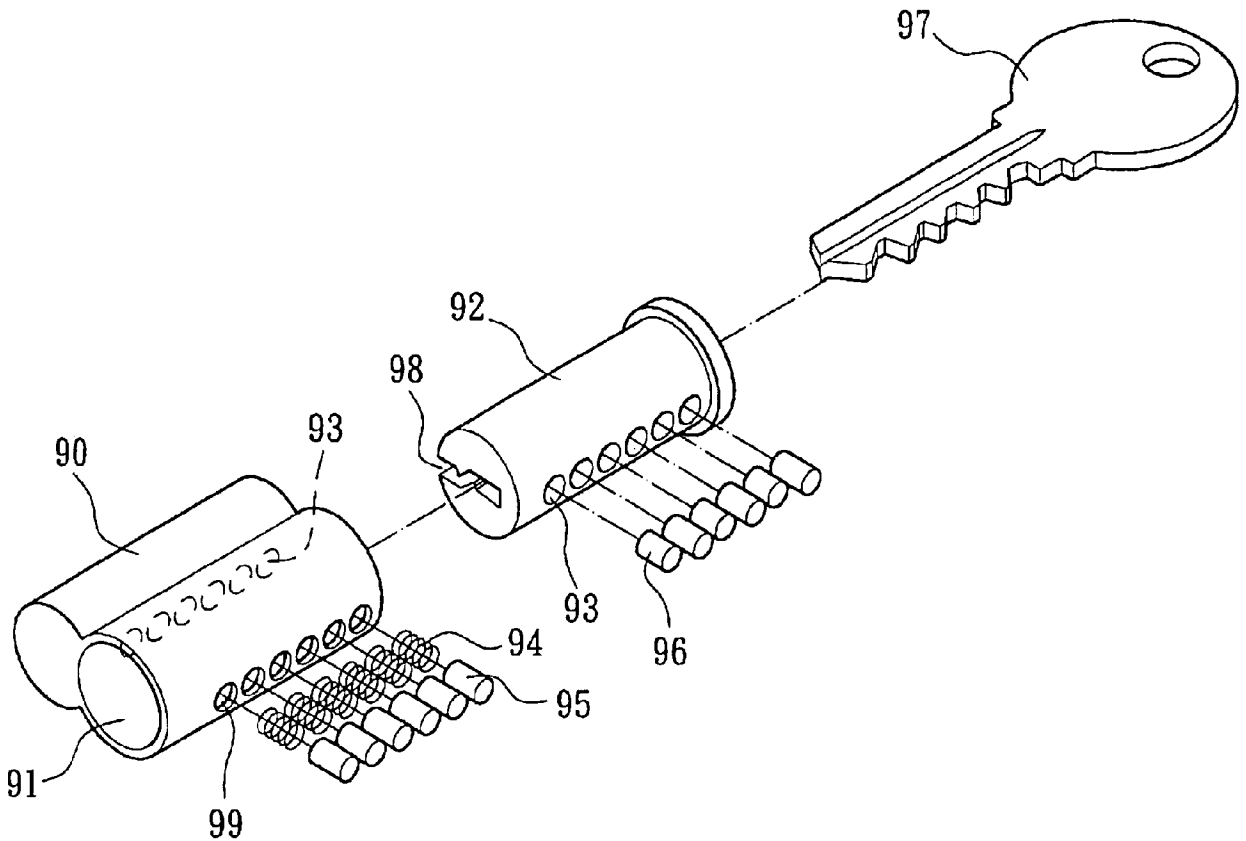
FIG. 1 PRIOR ART
FIG. 1 is an exploded perspective view of a cotter-pin type lock core and a key in accordance with the prior art.

Referring again to FIG. 1, it is a common problem in the lock core that an inappropriate rotation of the lock rotor 92 may align the pinholes 93 with the through holes 99 that may cause an accident release of the lower cotter pins 96 through the through holes 99. By contrast, the present invention adopts the semi-cylindrical casing 3 to seal the through holes 15 of the lock stator 1. However, the semi-cylindrical casing 3 accomplishes the prevention of the lower cotter pins 25 releasing from the pinholes 23 of the lock rotor 2. Therefore, it is convenient for changing the unwanted lower cotter pins 25 of the lock rotor 2.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A casing structure for a cotter-pin type lock core comprising:

a semi-cylindrical casing and a main body formed with a pinhole seat and a plurality of cotter-pin assembling through holes apart from the pinhole seat;

the semi-cylindrical casing comprising a first side wall including a first side edge and at least one first engaging portion extended therefrom, and a second side wall arranged opposite to the first side wall, and including a second side edge and at least one second engaging portion extended therefrom; and the first engaging portion and the second engaging portion are adapted to commonly engage with an outer circumference of the main body of the lock core to seal the plurality of cotter-pin assembling through holes, thereby preventing cotter pins of the lock core from release.

2. The casing structure for the cotter-pin type lock core as defined in claim 1, wherein the semi-cylindrical casing is made of elastical material selected from the group consisting of plastic and metal.

3. The casing structure for the cotter-pin type lock core as defined in claim 1, wherein the first side edge and the second side edge define a maximum diameter; and the first engaging portion and the second engaging portion define a width that is slightly smaller than the maximum diameter defined by the first side edge and the second side edge.

4. The casing structure for the cotter-pin type lock core as defined in claim 1, wherein the first side wall includes a pair of the first engaging portions proximate two ends of the semi-cylindrical casing.

5. The casing structure for the cotter-pin lock core as defined in claim 1, wherein the second side wall includes a pair of the second engaging portions proximate two ends of the semi-cylindrical casing.

6. The casing structure for the cotter-pin type lock core as defined in claim 1, further comprising a plurality of protrusions adapted to align with the through holes of the lock core and engaged therewith, thereby increasing in assembled relationship between the lock core and the semi-cylindrical casing.

7. The casing structure for the cotter-pin type lock core as defined in claim 6, wherein the protrusions have a common thickness identical with that of the through holes.

* * * * *